US005232540A

United States Patent [19]

Southwell et al.

[11] Patent Number: 5,232,540

[45] Date of Patent: Aug. 3, 1993

[54] AUTOMATIC LABELING MACHINE AND METHOD

[75] Inventors: Paul R. Southwell; Walter C. Miller, Jr., both of North Wilkesboro; Harold A. McKew, Jr., Moravian Falls, all of N.C.

[73] Assignee: Ithaca Industries, Inc., Wilkesboro, N.C.

[21] Appl. No.: 767,213

[22] Filed: Sep. 30, 1991

[51] Int. Cl.[5] ..... B65C 1/00

[52] U.S. Cl. ..... 156/361; 156/384; 156/542; 156/584; 221/71

[58] Field of Search ..... 156/541, 542, 361, 584, 156/384; 221/71, 73

[56] References Cited

U.S. PATENT DOCUMENTS

| | | | |
|---|---|---|---|
| 2,920,780 | 1/1960 | Hauschild | 156/542 X |
| 3,428,509 | 2/1969 | Messmer | 156/542 X |
| 3,436,294 | 4/1969 | Marano | 156/361 X |
| 3,450,590 | 6/1969 | Mers | 156/361 X |
| 3,970,506 | 7/1976 | Kwan | 156/542 X |
| 4,082,595 | 4/1978 | Slater | 156/361 X |
| 4,188,252 | 2/1980 | Brown | 156/361 |
| 4,214,937 | 7/1980 | Geurtsen et al. | 156/361 |
| 4,255,218 | 3/1981 | Stageberg | 156/361 X |
| 4,255,220 | 3/1981 | Kucheck et al. | 156/285 |
| 4,270,968 | 6/1981 | Dudzik et al. | 156/361 |
| 4,349,405 | 9/1982 | Dudzik | 156/358 |
| 4,367,118 | 1/1983 | Karp | 156/497 |
| 4,381,211 | 8/1983 | Nechay | 156/361 |
| 4,392,913 | 7/1983 | Baumli | 156/584 |
| 4,452,659 | 6/1984 | Geurtsen | 156/361 |
| 4,612,079 | 9/1986 | Ostrow | 156/542 X |
| 4,676,859 | 6/1987 | Cleary, Jr. et al. | 156/361 |
| 4,685,982 | 8/1987 | Kucheck | 156/361 X |
| 4,944,827 | 7/1990 | Lilly | 156/384 |
| 5,032,211 | 6/1991 | Shinno | 156/361 |
| 5,106,448 | 4/1992 | Freeman | 156/361 |
| 5,112,429 | 5/1992 | Costas | 156/361 X |

*Primary Examiner*—David A. Simmons
*Assistant Examiner*—Charles Rainwater
*Attorney, Agent, or Firm*—Olive & Olive

[57] ABSTRACT

A labeling machine is provided for the automatic transfer of labels with a pressure sensitive adhesive from a release backing to the surface of a package containing a product or to the surface of a product (hereinafter referred to as the "product". The labeling machine comprises a product transport system, a label transport system and a label transfer system. The product transport system moves the product into a labeling position. The label transport system moves labels which are on a backing from a supply reel, through a label stripper to separate the labels from the backing, and the backing continues to a takeup reel. The label transfer system picks up the labels stripped by the label stripper on a vacuum platen and applies the labels to the products being so identified.

9 Claims, 5 Drawing Sheets

| STEP | SWITCH ACTION | MACHINE ACTION |
|---|---|---|
| (A) | SWITCH 12 SENSES PRODUCT PASSING | -PRODUCT POSITIONING GATE 16 CLOSES<br>-CLUTCH CL/BR ON; ADVANCES LABEL<br>-VENTURI 80 GENERATES VACUUM (0.2 SEC. DELAY-T1) |
| (B) | PHOTO SWITCH 56 SENSES END OF LABEL | -CLUTCH TO BRAKE CL/BR; STOP LABEL |
| (C) | SWITCH 14 SENSES PRODUCT AT GATE | -LABEL APPLICATOR 20 DESCENDS<br>-TIMER T2 ON (0.5 SEC.) |
| (D) | TIMER T2 OFF; SWITCHES 32, 32' OPEN | -VENTURI 80 REVERSES FROM VACUUM TO PRESSURE<br>-OPEN PRODUCT POSITIONING GATE 16<br>-LABEL APPLICATOR 20 ASCENDS |

FIG. 1

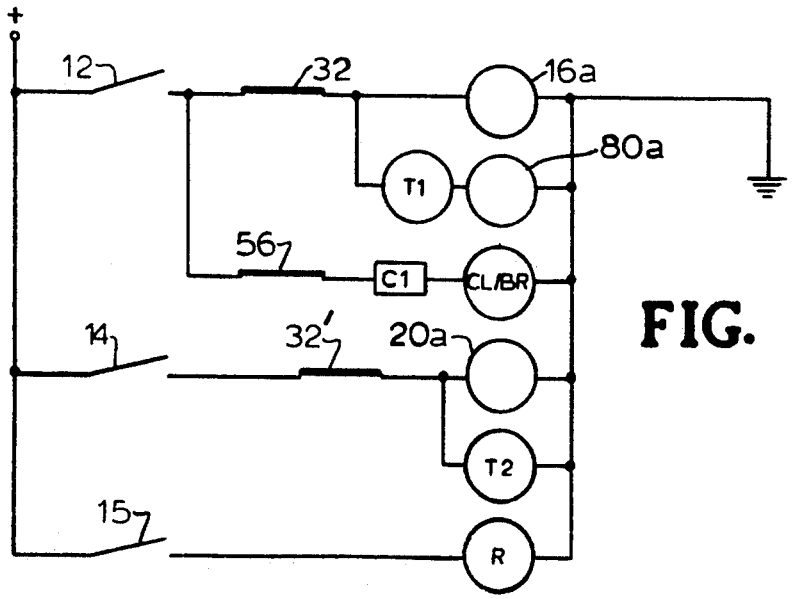

FIG. 10

AUTOMATIC LABELING MACHINE AND METHOD

FIELD OF THE INVENTION

This invention relates to the field of labeling machines, and more particularly to machines for the automatic transfer of pressure sensitive adhesive coated labels to packages containing products or directly to the products.

BACKGROUND OF THE PRIOR ART

Identification of a product by the application of a printed label on the product itself or on the package in which the product is contained is an important part of marketing and of providing information to the purchaser. The label must be informative and it may be decorative to add to the appeal of the package. Among the most popular and versatile types of labels in use today are those which use a pressure sensitive adhesive and which are typically supplied to the manufacturer of the product on a release coated backing film from which the label may be stripped readily.

In some instances a sales package may be preprinted with the required information, but there are many cases in which preprinting is not practical. The addition of a label makes the packaging and identifying process more flexible and allows the use of a single type of bag or box for a number of different products, thereby reducing the manufacturer's investment in packaging materials.

One particular example of the need for flexibility is in the textile field where a variety of sizes or styles of garments, i.e. shirts, underwear, etc. are packaged in plastic bags which must be labeled differently for consumer information, store inventory information, and pricing. It is often practical to use the same type bag to hold different kinds of garments. The applying of different labels to bags of the same type and which contain different products allows the required flexibility.

In addition to the needed flexibility of being able to put different labels on the same type bag, there is also a need to apply labels on different types of bags which contain different types of product. Thus, if the same manufacturer were to package socks in a small bag and pajamas in a large bag, machine flexibility as to the position, orientation and size of both package and label is also useful. The ability to variably orient the bag and the label in relation to each other makes design and customization simpler and possibly more effective.

In the prior art, U.S. Pat. No. 4,270,968 for "LABELLING DEVICE", U.S. Pat. No. 4,392,913 for "LABELLING APPARATUS", and U.S. Pat. No. 4,676,859 for "LABELING APPARATUS" describe machines for labeling and relate to some aspects of the problem being addressed and are included herein by reference. While each of these patents teaches an aspect of handling and applying a label to a package containing a product, the present invention provides a novel machine and method for labeling automatically with several unique features.

It is an objective of the present invention to provide a labeling machine which will control and position the product package to which the label is to be applied.

Another objective of the present invention is to provide a machine that will reliably and automatically apply a label to a variety of different sized and shaped packages.

A further objective of the present invention is to provide a labeling machine which will place a label on a package in a variety of positions and orientations according to the design of the package.

An additional objective of the present invention is to provide a labeling machine which will adapt to and handle various sized labels.

A still further objective of the present invention is to provide a labeling machine which will control the feeding of the labels to the product package in a simple and effective manner.

The specific objectives mentioned above and others as will occur to the person skilled in the art will become apparent as the disclosure following is read.

SUMMARY OF THE INVENTION

The invention disclosed relates to an automatic labeling machine and method for use in placing a variety of labels on a variety of different sized and shaped packages in a manufacturing environment. The machine described incorporates a series of switches on the packaged product conveyor to sense the approach of the packages, interpose a positioning gate, and actuate a label transport system. The label is moved forward through a unique label stripper with its release backing until the driving mechanism is stopped by a signal from a photosensitive switch. The label is next picked up by a vacuum platen and applied to the surface of the package containing the product held at the gate. At the point of application, the vacuum, which is generated by a Venturi tube, is reversed to a blast of positive pressure to ensure proper adhesion of the label to the package.

While described in reference to labeling packages containing products, it is to be recognized that the automatic labeling machine and method of the invention may also be used for applying labels directly to the surfaces of products.

BRIEF DESCRIPTION OF THE DRAWINGS

FIG. 1 is a flow chart which relates switch actions to machine actions in the method of labeling and operation of the labeling machine of the invention.

FIG. 10 is a schematic diagram of the electrical components used in the labeling machine system.

DESCRIPTION OF THE PREFERRED EMBODIMENT

Figure 2:
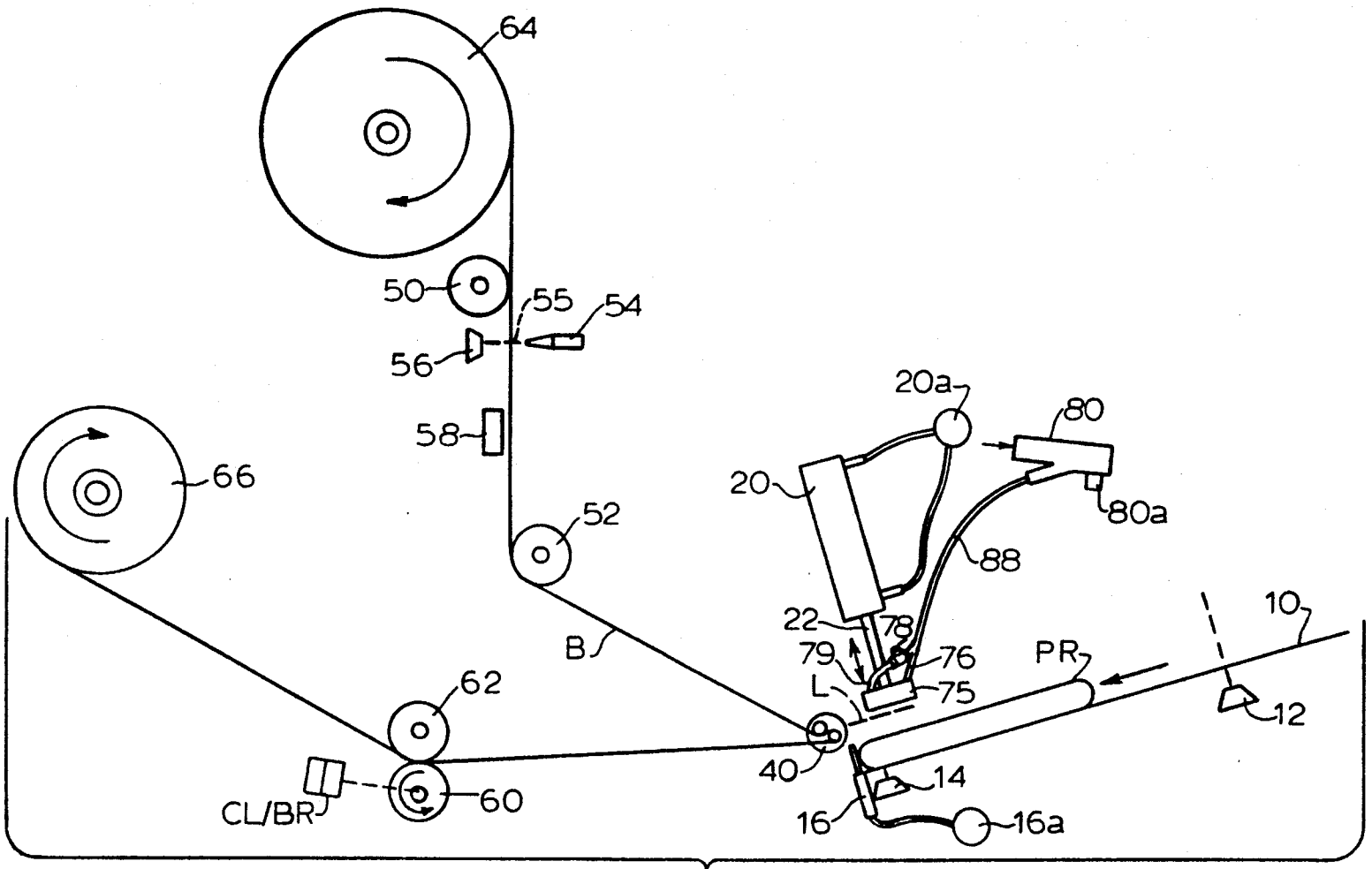
FIG. 2 is a schematic elevation view of the labeling machine illustrating the principal operative components of the invention which are typically supported by a frame, not shown.

In the flow chart which relates switch actions with corresponding machine actions as shown in FIG. 1 the sequence of operations of the labeling machine (illustrated in FIG. 2) of the present invention is outlined. A label may be applied by the labeling machine of the invention to either a box or a bag containing a product or to a product surface directly. The object to be labeled, for example a plastic bag containing a shirt, is brought to the labeling machine by a mechanical conveyor or a gravity conveyor chute which conforms fairly closely to the width dimension of the object.

The sequence of operations described below as shown in FIG. 1 is conducted by the labeling machine illustrated schematically in FIG. 2. The overall operating system of the labeling machine of FIG. 2 may be thought of as involving three interrelated systems which are actuated according to the series of controls briefly outlined above. One system is the product package PR conveyor system. A second system involves the movement of label L and backing B. A third system transfers label L from backing B to the product package PR.

In step A of the flow chart of FIG. 1, switch 12 senses the product package approaching the labeling position on the conveyor which action initiates the complete machine sequence. Switch 12 sends a signal to a product package positioning gate solenoid valve 16*a* which acts to close gate 16 which is adapted to stop the product package in a known location. Gate 16 is activated by the signal to block the path of the product package in a labeling position below a label applicator 20. Simultaneously, switch 12 also actuates electrical clutch CL/BR and vacuum initiating timer Tl. Clutch CL/BR couples a drive to a label advancing roller 60 so as to cause one label in a series of labels on a release backing to be advanced. The timer Tl operates and after a preset interval of time connects a vacuum source to platen 75 of the label applicator 20. The preset time interval is established in the example as 0.2 seconds to allow the label being advanced by the drive the time needed to arrive at the label applicator platen 75. When timer Tl acts to connect the vacuum source to the platen 75, the suction created picks up the label and holds it by the non-adhesive side, leaving the adhesive side exposed and facing toward the package containing the product.

The forward motion of labels and backing which was initiated by switch 12 in step A continues until stopped by photosensitive switch 56 in step D as discussed in greater detail below. The signal generated by photo switch 56 deactivates the clutch CL/BR and simultaneously activates a brake portion, stopping label motion.

When the package to be labeled is in labeling position against gate 16, switch 14 senses the product package PR in step B and signals the label applicator 20 which is holding the label by vacuum. The label applicator 20 descends by action of a linearly actuatable pneumatic cylinder.

Once platen 75 with the label is in close proximity to the product package, the vacuum which has been holding the label is no longer needed. When switch 14 caused the label applicator 20 to descend, it also started timer T2 to run for a cycle of 0.5 seconds. In step C timer T2 concludes its 0.5 second period and causes the direction of air flow through platen 75 to change from vacuum to pressure. This causes a rapid blast of air to exit platen 75 and positively release the label from platen 75 and onto the product. Reversing vacuum to pressure at platen 75 augments the primary mechanical force applying the label to the product package, thus overcoming the tendency of the label to remain on platen 75.

At the same time as timer T2 activates the air flow reversal from vacuum to pressure, it also causes the stroke of the label applicator 20 to reverse and return the platen 75 to the top position. Product position gate 16 is also reversed so as to open and allow the product package PR, now having been labeled, to pass.

In FIG. 2, conveyor 10, which may be a gravity chute or a driven conveyor, is configured with adjustable side plates so as to conform to the width of the product package PR. The width of conveyor 10 is adjusted so as to be sufficient to allow the product package PR to freely pass but close enough to the width of the product package PR to restrict significant lateral movement. The bed of conveyor 10 may be of any appropriate design, including rollers or air cushion friction relief. Conveyor 10 conveys the product package PR into a position to be labeled by the machine. Positioned adjacent conveyor 10 are product package approach switch 12, product package positioning gate 16 and product package position switch 14.

Conveyor 10 is illustrated in the preferred embodiment as a gravity chute mounted at an angle to the horizontal sufficient to allow product package PR to move smoothly to the appropriate position below the labeling machine to receive a label in a specified location. In other embodiments, such as a driven belt conveyor, conveyor 10 may be mounted horizontally. In either configuration switch 12, which acts to sense the approach of product package PR, is located adjacent conveyor 10 a distance from the desired labeling location greater than the length of product package PR. Product package positioning gate 16 is mounted adjacent conveyor 10 in a location so that, when closed, it will stop the forward movement of product package PR in the desired labeling location. Product package switch 14 is located adjacent conveyor 10 in a position to sense the presence of product package PR in the desired labeling position.

In operation, product package PR travels along conveyor 10 in the direction of the arrow. As product package PR actuates product package approach switch 12, switch 12 transmits a signal to solenoid valve 16*a* which conducts pressurized air so as to close gate 16. Position gate 16 is configured as a plurality of parallel rigid bars attached to a pneumatic cylinder and is mounted perpendicular to the plane of conveyor 10. Gate 16 when closed acts to block the travel of product package PR on conveyor 10, thus stopping each product package PR in a known position for repeatable, accurate label placement thereupon. When product package PR moves into position adjacent gate 16 for label application, product package position switch 14 closes. The signal generated by position switch 14 activates label applicator cylinder 20 by means of solenoid valve 20*a* and moves platen 75 downwardly to bring label L with its adhesive side facing product package PR into contact with product package PR so as to adhere to the surface thereof. Switches 12, 14 may be of a physical contact, photosensitive, or other style to detect the package or product to be labeled.

The labels which are correct for use in the machine and method disclosed herein are coated on a first side with a pressure sensitive adhesive and laminated onto a flexible backing sheet. Next the label material is printed on a second side and die cut to size, still adhered to the release backing. Die cutting will create an open space between labels and space all labels uniformly separated on the backing sheet. The space used in the preferred embodiment between adjacent labels is 0.125 inch (3.175 mm). The composition of the adhesive and the backing release coating, as is known in the manufacture of labels, are such that the adhesive coated label may be easily removed from the backing but it will stick firmly to other types of surface, particularly the product or package being labeled. The laminated labels and backing are then wound into a roll for mounting on the machine supply reel.

Labels L with backing B are transported from supply reel 64 through the machine. Supply reel 64 is driven by the tension on backing B as backing B is pulled forward by intermittently driven roller 60 in conjunction with idler 62. Roller 60 is driven through clutch/brake set CL/BR as discussed below. Reel 64 is equipped with a braking device (not shown) to prevent overspin and to maintain tension on backing strip B. The tension on backing B is desirable in order to properly strip label L from backing B and to keep backing B in a straight line between each pair of consecutive devices in its path through the labeling machine as will be further discussed. Backing B travels from supply reel 64 over idler 50 so that the segment of backing B beyond idler 50 is maintained in constant alignment regardless of the then current diameter of the supply quantity of backing B and labels L on reel 64. Takeup reel 66, driven by a slip clutch, winds up backing B from which labels L have been stripped.

After backing B and labels L pass idler 50, their path intersects a line between light source 54 and photosensitive switch 56 which devices are axially aligned with each other. Photosensitive switch 56 is adjustable in its degree of light sensitivity in a range at least sufficient so that the amount of light from light source 54 which passes through backing B alone will actuate switch 56 but the amount of light which passes through backing B plus label L is insufficient to so actuate.

Figure 3:
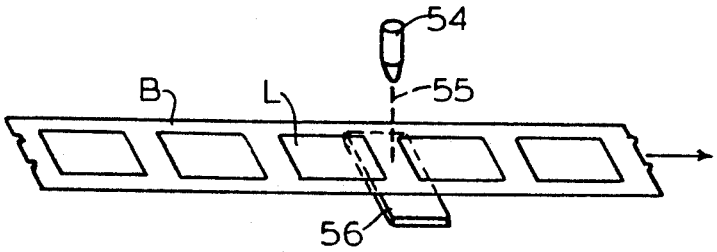
FIG. 3 is a perspective depiction of a series of pressure sensitive labels as supplied on a typical release backing strip and illustrated passing between a light source and photosensitive switch positioned for use.

FIG. 3 is a perspective representation of a series of labels L on backing B with light source 54 and photosensitive switch 56 operative thereupon. As it is illustrated, there is a gap separating each adjacent pair of labels L on backing B which gap creates a differential in light transmissibility which the photosensitive detection apparatus can sense and to which it can react. As backing strip B moves in the direction of the arrow and passes light beam 55 emitted by light source 54, the beam alternatingly impinges plain backing B and the combination of backing B plus label L. The difference in light transmissibility of the two alternating substrates results in differing amounts of light passing through. Photosensitive switch 56, which receives and responds to light beam 55 from light source 54, will therefore detect the end of each label L and generate a signal. The signal generated will actuate the brake portion of clutch/brake CL/BR and stop the movement of backing B and labels L. In the preferred embodiment, light source 54 is fiber optic unit lR23PMRA and photosensitive switch 56 is sensor OSBFV, both connected to power block OPBT2, all items supplied by Banner Electronics. Other types of signal generation and signal sensing capable of detecting label movement may be employed, such as electrical capacitance or light reflection.

A heater 58 (FIG. 2) is located between idlers 50, 52 and adjacent the path of backing B in close proximity thereto so as to warm the adhesive layer of label L. By so warming the adhesive, label L will release more easily from backing B and subsequently adhere more firmly to the product package PR when applied thereto and cooled. In the preferred embodiment heater 58 is an electric resistance type heater which operates continuously and has variable power input so as to enable regulation of the temperature achieved and thus the effect on the label adhesive.

After changing direction around idler 52, backing B next travels to and through label stripper 40 where each label L is removed from backing B. Label stripper 40 is shown in enlarged detail in FIGS. 4, 5, 6A, 6B, 6C. FIG. 5 shows label stripper 40 in perspective view as label L is being stripped and projected off backing strip B. Backing B is being pulled under tension in the direction of the arrow and passes under control bar 44 and approaches stripper bar 46. Backing B sharply reverses its direction of travel over the small radius of bar 46 as it passes around bar 46 while label L, due to its stiffness, continues moving forward in a straight line. Stripping label L from backing B by making a change in direction around a small radius has been made easier and more reliable by first warming the adhesive of label L by heater 58 as described above. As will be shown below, label L is now in position to be temporarily picked up by platen 75 (FIG. 4).

Figure 5:
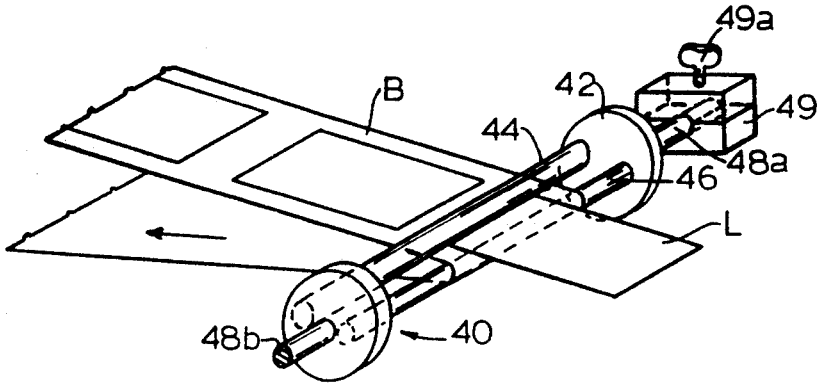
FIG. 5 is an enlarged perspective view of the label stripping device with a label projected therefrom.
Figure 6A:
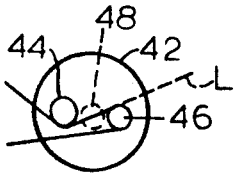
FIG. 6A is a schematic drawing of the label stripping device adjusted to dispense the labels in an upwardly angled orientation.
Figure 6B:
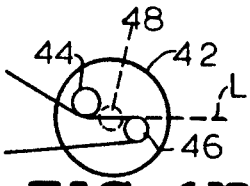
FIG. 6B is a schematic drawing of the label stripping device adjusted to dispense the labels in a level orientation.
Figure 6C:
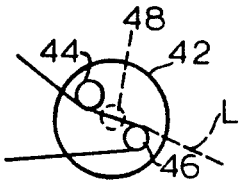
FIG. 6C is a schematic drawing of the label stripping device adjusted to dispense the labels in a downwardly angled orientation.

Label stripper 40 may be adjusted in its angular orientation to accommodate and properly strip various sizes and configurations of label. As illustrated in FIG. 5, stripper 40 is mounted on shafts 48*a*, 48*b* which may be centrally positioned as shown in the preferred embodiment or eccentrically positioned with respect to side plates 42. Shafts 48*a*, 48*b* are fixedly connected to the outward facing surfaces of each side plate 42 and are axially aligned with each other. Control bar 44 and stripper bar 46 are substantially parallel to each other and fixedly mounted to and between side plates 42. Bars 44, 46 are separated from each other by a distance at least sufficient to allow label L and backing B to pass therebetween. In the preferred embodiment, stripping bar 46 is 0.125 inch (3.175 mm) in diameter and control bar 44 is 0.1875 inch (4.7625 mm) in diameter. The center lines of bars 44, 46 are separated by 0.500 inch (12.7 mm). Whereas the preferred embodiment employs a pair of smooth surfaced, rigid, round bars, other cross sectional shapes may be used if desired. A support bearing (not shown) supports the outer end of shaft 48*b*. A split block locking clamp 49, which is tightened by thumbscrew 49*a*, supports the end of shaft 48*a*. By releasing locking clamp 49 so shaft 48*a* may be rotated, the relative positions of bars 44, 46 are adjusted as is depicted in FIGS. 6A, 6B, 6C. An alternate configuration wherein shafts 48*a*, 48*b* and stripper bar 46 are coaxial will function adequately to strip and position labels L with precision. The rotating of stripper 40 and repositioning of bars 44, 46 allows for precise adjustment of the projecting angle of label L as it separates from backing B. This obtains a fine control of the position of label L on platen 75 and subsequently on each product package PR. As will be understood by those skilled in the art, the ability to adjust the relative angle between label L and platen 75 is useful to adjust for accurate positioning of labels of different sizes and different degrees of stiffness. As will be seen by comparison of FIGS. 6A, 6B, 6C the degree of adjusting label stripping angle is substantial and reliable.

Figure 4:
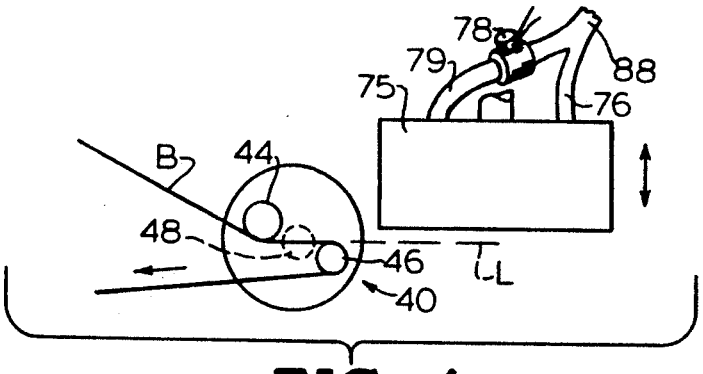
FIG. 4 is an enlarged detail elevation drawing of the label stripping device of the invention dispensing a label and the vacuum platen positioned to receive said label.

FIG. 4 illustrates that label L parts from backing B and is immediately taken up by the vacuum suction applied by tube 88 through platen 75. It is important when loading the machine with labels to orient the label supply roll so that the printed side of labels L will be closest to platen 75 and the adhesive side of label L is facing toward product package PR for adhesion thereto. Platen 75 is fixedly mounted to the free end of rod 22 of cylinder 20.

Returning to FIG. 2, after backing B has passed stripper 40 and label L has been transferred to platen 75, backing B continues toward mating rollers 60, 62 which are the sole means of tension and drive for the backing through the machine to that point. Roller 60 is driven intermittently by a motor through electrically operated clutch/brake set CL/BR. Roller 62 is an idler which presses against driven roller 60 so as to clamp and positively control backing B. When the brake is applied and the clutch is simultaneously released, rollers 60, 62 stop rotating and backing B stops moving. The braking device connected to supply reel 64 stops reel 64 from further rotation once roller 60 stops pulling backing B. Takeup roll 66, which functions to collect the stripped backing, is somewhat smaller in diameter than supply roller 64 due to the fact that backing B alone requires less volume to store after labels L have been removed. Takeup roller 66 will preferably be continuously urged to rotate by means of a slip clutch (not shown) connection so that roll 66 will maintain constant tension on backing B and wind up backing B when rolls 60, 62 move backing B forward. When rollers 60, 62 are stopped, roller 66 will be still and the slip clutch will continue to rotate. In construction of the labeling machine of the invention, the drive for roller 60 and takeup roll 66 may be derived from the same motor source and transmitted by chains, gears, etc. to the respective clutch/brake or slip drive unit or the like.

Figure 7A:
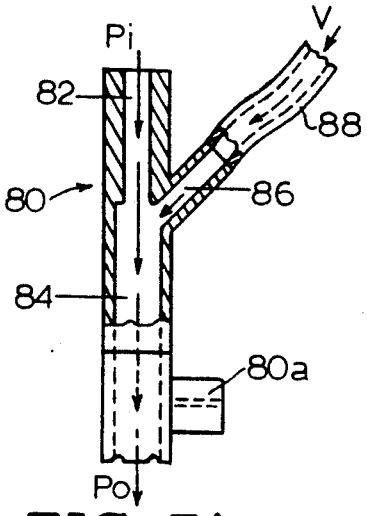
FIG. 7A is a sectional elevation drawing of the Venturi tube with an open solenoid valve so as to function to create a vacuum at a vacuum location.
Figure 7B:
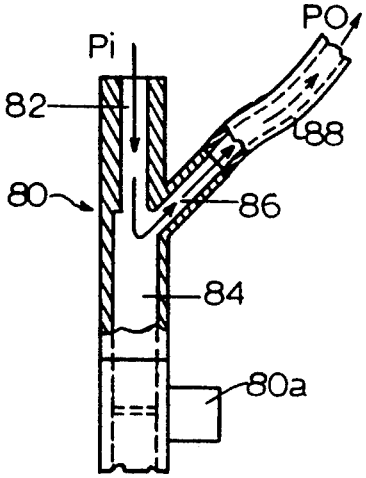
FIG. 7B is a sectional elevation drawing of the Venturi tube with a closed solenoid valve so as to function to transmit a positive pressure at the prior vacuum location.

The vacuum for holding labels L to platen 75 is generated by Venturi tube 80 and transmitted by tube 88 as shown in detail in FIGS. 7A, 7B. The major function of Venturi tube 80 is the conventional operation of establishing a moderate vacuum by the use of a pressurized air flow as shown in FIG. 7A. By infusing pressurized air Pi into inlet 82 and out of outlet 84 as Po, an increase in diameters within the tube from inlet 82 to outlet 84 will cause a vacuum V to occur at the point that the internal diameter increases, which vacuum is transmitted to vacuum inlet 86. Inlet 86 is connected to platen 75 by tube 88 and the vacuum V thus created is transmitted to platen 75 to hold label L. In this way, a manufacturing facility that has a supply of pressurized air can simply create a moderate vacuum.

When label L is moved downward into label applying contact with the product package PR by label applicator pneumatic cylinder 20, Venturi solenoid valve 80*a* closes outlet 84 as seen in FIG. 7B. This valve closing causes the pressurized air Pi entering inlet 82 to be rapidly forced out through outlet 86. This air runs through tube 88 replacing vacuum suction to platen 75 and blowing label L off platen 75.

Figure 8:
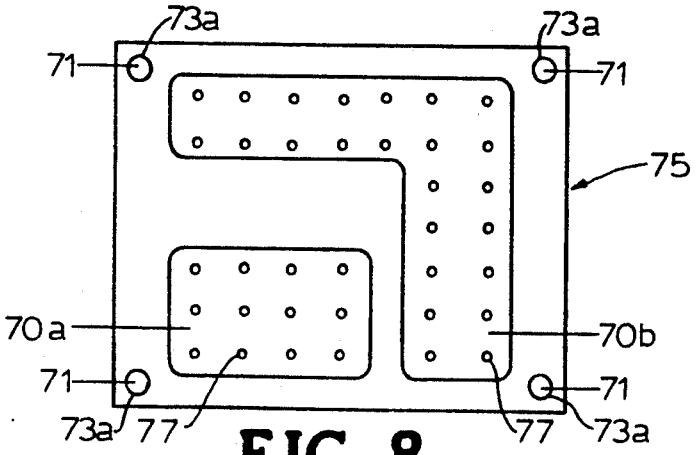
FIG. 8 is a bottom plan view of the vacuum label pickup platen.
Figure 11:
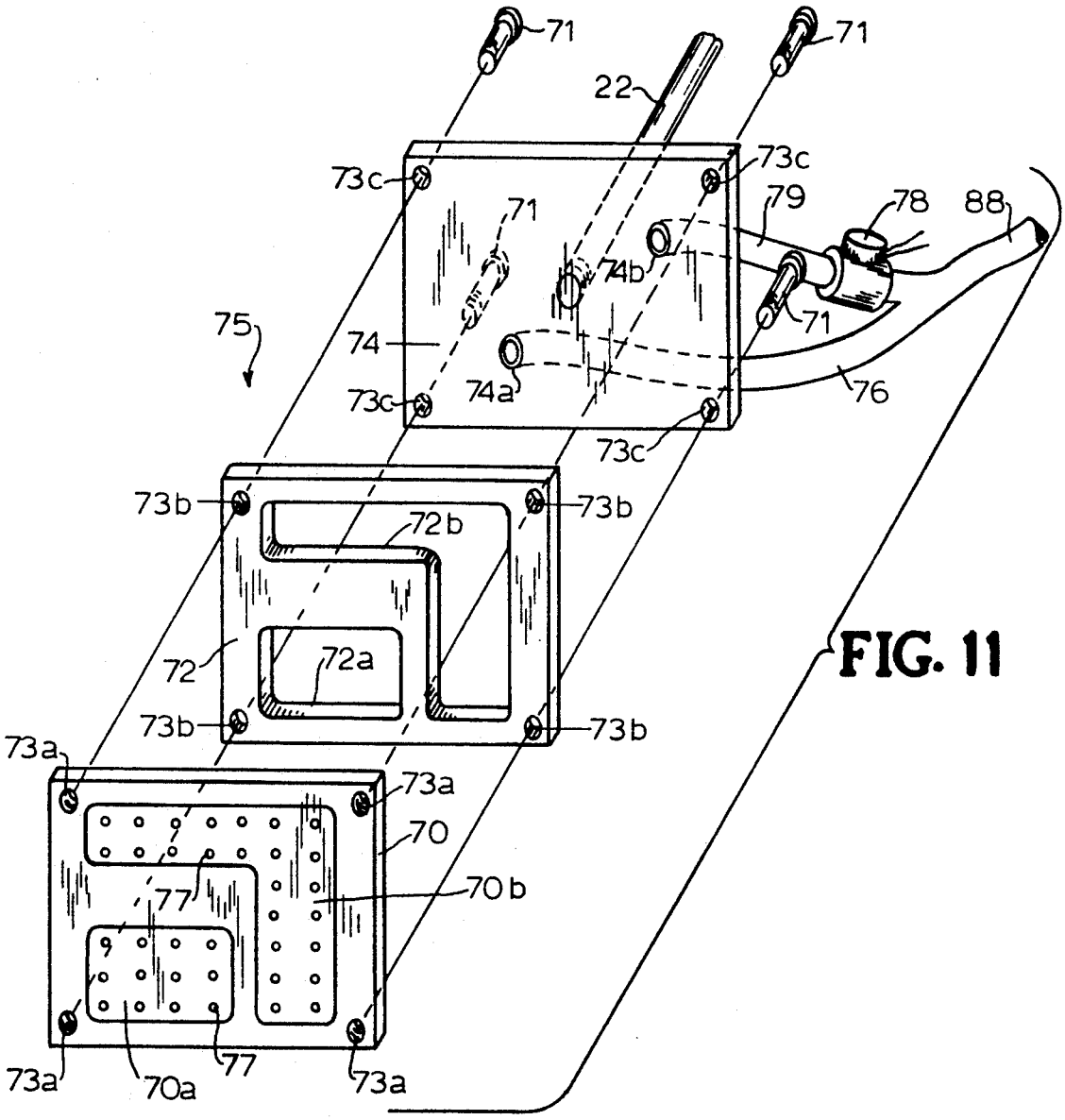
FIG. 11 is an exploded perspective view of the vacuum label pickup platen.

A further detail of the face of platen 75 is shown in FIGS. 8, 11, a bottom plan view and exploded assembly of platen 75. The vacuum which holds label L onto platen 75 is conducted to the surface through a series of small holes 77 in face plate 70. In the preferred embodiment, air passage holes 77 are configured as two segments, an inner rectangle 70*a* and an outer "L" shaped segment 70*b*. Ducts in channel plate 72 direct vacuum suction to segments 70*a*, 70*b* separately, with the duct to "L" shaped segment 70*b* able to be closed by valve 78. By this means, the vacuum may be applied to both segments 70*a*, 70*b* or to only the smaller rectangular segment 70*a*, allowing for an adjustment of the operative size of the vacuum surface to accommodate labels L of different sizes. In alternate embodiments, other numbers of groups of holes 77 may be configured having some or all of these groups controlled by shutoff valves.

FIG. 11 illustrates the inner workings of platen 75 by an exploded view. Platen 75 is comprised of three substantially flat plates of substantially similar external dimensions, face plate 70, channel plate 72 and connecting plate 74. Plates 70, 72, 74 are assembled by means of screws 71 which pass through holes 73*a*, 73*b*, 73*c* at each corner of the three plates with the holes 73*a* in face plate 70 being internally threaded to match the thread of screws 71. Plates 70, 72, 74 are assembled with interspersed gasket material or compound (not shown) to prevent air leaks.

Connecting plate 74 is fixedly attached to piston rod 22 of cylinder 20. Also attached in pneumatic communication through plate 74 are connecting tubes 76, 79 which are commonly connected to tube 88. Tube 79 is supplied from tube 88 through valve 78 which valve is operative to shut off the connection to tube 88.

Channel plate 72 has two holes formed therethrough, rectangular hole 72*a* and "L" shaped hole 72*b*, which holes are similarly sized and shaped to segments 70*a*, 70*b* of holes 77 through face plate 70. Thus, tube 76 is positioned in connecting plate 74 so that when plates 70, 72, 74 are pressed together in assembly, vacuum or air from tube 76 will flow through hole 74*a* in connecting plate 74 and through hole 72*a* in channel plate 72 and segment 70*a* of holes 77 in face plate 70. Similarly, tube 79 is positioned in connecting plate 74 so that when plates 70, 72, 74 are assembled, vacuum or air from tube 79 will flow through hole 74*b* in connecting plate 74 and through hole 72*b* in channel plate 72 and through segment 70*b* of holes 77 in face plate 70. When valve 78 is shut by appropriate control, not shown, vacuum or air will be supplied only to tube 76, hole 74*a*, hole 72*a*, and segment 70*a*, thus reducing the operative size of the face of platen 75.

As described above, the labeling machine of the present invention has substantial capability to adjust to accommodate labels of different size and different paper stiffness. The use of labels of a shape other than rectangular may be handled by using a portion of platen 75 as described and illustrated or by using a platen of similar concept but dissimilar physical configuration. As an example, a round label may be used with the present platen if it covers enough of the platen holes 77, or it may be better accommodated with a platen having a round pattern of holes.

Figure 9:
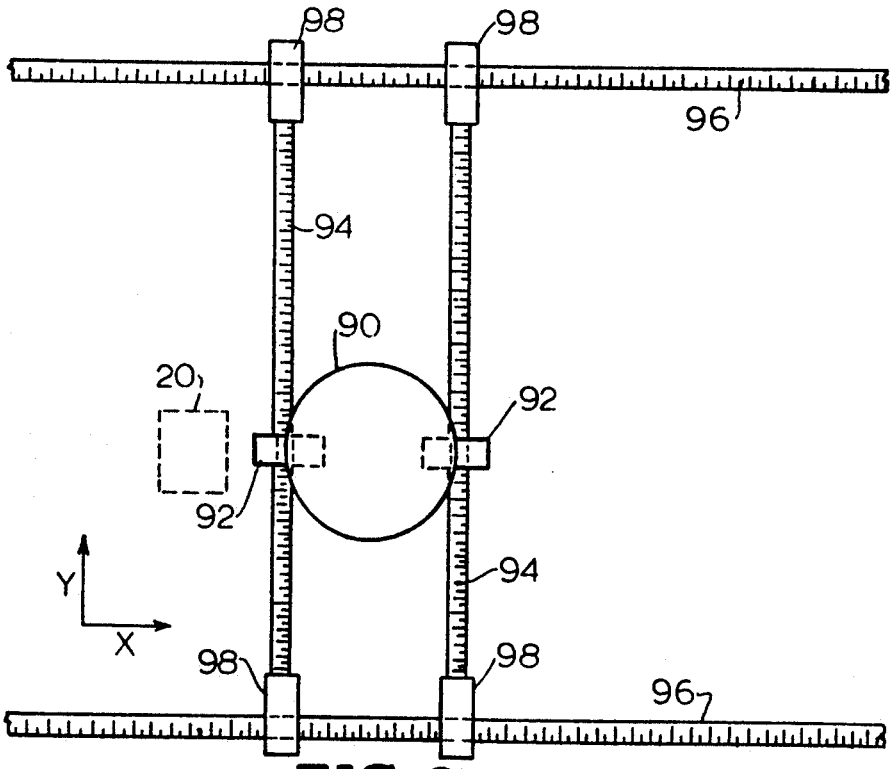
FIG. 9 is a schematic plan drawing of the three way adjustable mounting apparatus of the labeling machine.

Further, it may be required to place a label onto a package or product in a different orientation or location. If, for example, the primary labeling location were the lower left hand corner of the package or the product, one may have to place the label in the upper right hand corner. Alternatively, if the label were required to be rotated 90° or 180°, other means of adjustability are needed. The entire labeling machine of the invention is mounted on location adjusting units as shown in FIG. 9. The labeling machine is mounted on turntable 90 which is able to be rotated and locked in increments of 90°. Other degrees of angular adjustability could be adapted, as well. The labeling machine is placed on turntable 90 so label applicator 20 is radially beyond the periphery of turntable 90 and can descend to apply labels to product package PR without interference as may be needed in any orientation. A representative placement for the labeling machine is indicated by the location of applicator 20, shown in dashed lines, as will allow labels to be applied to a package product below the mounting apparatus.

Turntable 90 is supported on linear traverse nuts 92 which travel along lead screws 94 when screws 94 are rotated. Lead screws 94 are actuated by a common drive (not shown) so as to impart motion to both nuts 92 simultaneously, causing turntable 90 with the labeling machine to move along a path parallel to screws 94. The ends of each lead screw 94 are mounted into cross blocks 98 which have low friction bearings adapted to hold screws 94 and allow them to rotate freely. In holes perpendicular to the bearings of blocks 98 are internal lead threads which match the threads of transverse lead screws 96. Screws 96 are similarly commonly driven. Thus, it is seen that rotation of screws 96 moves the labeling machine mounted on turntable 90 in a "X" linear direction, rotation of screws 94 moves the machine in a "Y" linear direction and rotation of turntable 90 moves the machine angularly. Therefore, the objectives of label placement versatility are accomplished. Actuation of the turntable or lead screws by pairs is done according to the preferred embodiment by means of crank arms, each shaft having a locking ability. Alternate means, such as a motorized screw drive may likewise be employed.

FIG. 10 portrays the electrical control circuit for the machine functions described. The illustrated circuit enables a voltage source on the left side to be connected to ground on the right side when all the switches in a connecting horizontal line are closed. Switch 12 (which senses the approach of product package PR) closes to actuate product package position gate solenoid valve 16*a* and vacuum timer Tl through normally closed switch 32. Valve 16*a* closes product package position gate 16 and vacuum is actuated at the completion of the cycle of timer Tl by solenoid valve 80*a* actuating Venturi tube 80. Switch 12 also activates counter Cl and the clutch part of the clutch/brake set CL/BR through normally closed photo switch 56. Alternate initiation of label advancement, such as label applicator 20 returning to its top position, may be employed. When counter Cl goes from zero to one and photo switch 56 senses the end of label L, switch 56 opens, signifying the passing of a single label, and reverses clutch/brake CL/BR from clutch function to brake function, stopping label L. Counter Cl may be any device to restrict actuation of backing B so only a single label L is advanced each cycle.

When product package PR stops at the labeling position adjacent gate 16, product package PR is sensed by switch 14 which closes, energizing label applicator cylinder 20 by solenoid valve 20*a* and timer T2 through normally closed switch 32'. Solenoid 20*a* causes applicator 20 to descend. Timer T2 runs through its cycle and when completed closes switch 15 which actuates relay R. Relay R opens normally closed switches 32, 32'. As seen above, switch 32 will open to open gate 16 through solenoid 16*a* and reverse vacuum to pressure by solenoid 80*a*. Switch 32' will cause label applicator 20 to be raised by action of solenoid 20*a*.

The electrical actions described here, in practical application are augmented by relays to affect the machine actions needed. Alternatively, the electrical system may be manifest in a fixed or programmable logic circuit. Such description is here omitted to concentrate on principles.

Whereas the major components and their operative relationships were described herein in schematic form, it is to be understood that the actual machine is constructed about a frame which serves to support and to contain the various devices.

Having disclosed the present invention by means of a preferred embodiment, it is to be understood by those skilled in art that other possible variations may be developed. The example used herein is, therefore, not to be construed as a limitation of the principles and the scope of the invention.

We claim:

1. A labeling machine for the automatic transfer to the surface of a package containing a product or to the surface of a product (said package and product being hereinafter referred to as the "product") of a pressure sensitive adhesive coated label forming one of a series of such labels releasably secured in spaced apart positions on a light transmitting flexible release backing, said labeling machine comprising:

(a) a supply reel adapted for having mounted thereon a roll of continuous length release backing with spaced apart pressure sensitive adhesive coated labels laminated thereto;

(b) a takeup reel adapted for reeling onto said takeup reel said continuous length of release backing after said labels have been stripped therefrom, said release backing normally extending along a defined path between said supply and takeup reels;

(c) a label stripping device coated in said path between said supply and takeup reels and adapted for stripping each successive label from said release backing during passage through said stripping device and for positioning each such stripped label so that the plane of said stripped label is angularly variable with respect to the plane of said defined path immediately prior to said backing contacting said stripping device so as to place said label in a first position overlying a labeling position for the product to be labelled, said label stripping device comprising:

(i) a pair of substantially parallel equal-length stripping bars each having a first and a second end;

(ii) a pair of substantially parallel side plates mounted to said first and second end respectively of said stripping bars and rotatably adjustable to position said stripped label accurately in said first position; and (iii) releasable clamping means capable of allowing the rotational adjustment and the locking of said side plates and stripping bars in the adjusted position;

(d) a label applicator device having a platen with a substantially flat bottom surface and apertures formed in said platen communicating with said bottom surface, having means to selectively apply a vacuum or positive air pressure to said apertures and having means to raise and lower said platen, said platen being operative when vacuum is applied to grasp said stripped label from said label stripping device at said first position, and when said platen is lowered to a second position contacting the product in said labeling position to apply positive air pressure through said apertures to adhere the stripped label to the product;

(e) means to stop the product in said labeling position below the platen in coordination with stripping and placement of said label in said first position;

(f) means to advance the release backing having said pressure sensitive adhesive coated labels laminated thereon; and (g) means to stop the advance of said backing and labels responsive to a signal generated by a sensing device operative to sense the advance of each said label.

2. The labeling machine as claimed in claim 1 wherein said platen is configured with said apertures arranged in segments, said means to selectively apply said vacuum or pressure being separately connected to each of said segments and one or more of said segments of apertures having valve means enabling said vacuum or pressure to be selectively disconnected therefrom.

3. The labeling machine as claimed in claim 2 wherein said means to selectively apply a vacuum or pressure to said apertures comprises:

(a) a Venturi tube having an air inlet port, an air outlet port and a vacuum port and with a source of pressurized air connected to said inlet port and further having said vacuum port connected such that a vacuum is generated at the vacuum port when said pressurized air is connected to the air inlet port; and (b) a solenoid valve operative when energized to close said outlet port to cause said pressurized air to be forced out of said vacuum port as a pressure exhaust.

4. The labeling machine as claimed in claim 1 wherein said sensing device operative to sense the advance of each label comprises:

(a) light source means positioned to direct a beam of light at and through said release backing and series of spaced apart labels laminated thereon;

(b) photosensitive switch means axially aligned with said light source means and capable of reacting to reception of the beam of light by actuating an electric circuit; and (c) sensitivity adjustment means capable of adjusting the photosensitive switch so that it will react to differing levels of light received.

5. The labeling machine as claimed in claim 4 further comprising a slip clutch driving means adapted and connected to apply rotational force to said takeup reel.

6. The labeling machine as claimed in claim 5 in which said means to advance said release backing comprises a driving shaft and an electrically actuated clutch/brake unit.

7. The labeling machine as claimed in claim 6 further comprising a heater mounted adjacent the path of travel of said labels and backing in a location intermediate said supply reel and said label stripping means and adapted to warm the adhesive layer of said labels.

8. A labeling machine for the automatic transfer to the surface of a package containing a product or to the surface of a product (said package and product being hereinafter referred to as the "product") of a pressure sensitive adhesive coated label forming one of a series of such labels releasably secured in spaced apart positions on a light transmitting flexible release backing, said labeling machine comprising;

(a) a supply reel adapted for having mounted thereon a roll of continuous length release backing with spaced apart pressure sensitive adhesive coated labels laminated thereto;

(b) a takeup reel adapted for reeling onto said takeup reel said continuous length of release backing after said labels have been stripped therefrom, said release backing normally extending along a defined path between said supply and takeup reels;

a label stripping device located in said path between said supply and takeup reels and adapted for stripping each successive label from said release backing during passage through said stripping device and for positioning each such stripped label so that the plane of said stripped label is angularly variable with respect to the plane of said defined path immediately prior to said backing contacting said stripping device so as to place said label in a first position overlying a labeling position for the product to be labelled, said label stripping device comprising:

(i) means to sharply reverse the direction of said release backing; and (ii) means to alter the angular orientation of said backing reversing means with respect to said defined path so as to control the position of said label relative to said first position;

(d) a label applicator device having a platen with a substantially flat bottom surface and apertures formed in said platen communicating with said bottom surface, having means to selectively apply a vacuum or positive air pressure to said apertures and having means to raise and lower said platen, said platen being operative when vacuum is applied to grasp said stripped label from said label stripping device at said first position, and when said platen is lowered to a second position contacting the product in said labeling position to apply positive air pressure through said apertures to adhere the stripped label to the product;

(e) means to stop the product in said labeling position below the platen in coordination with stripping and placement of said label in said first position;

(f) means to advance the release backing having said pressure sensitive adhesive coated labels laminated thereon; and (g) means to stop the advance of said backing and labels responsive to a signal generated by a sensing device operative to sense the advance of each said label.

9. A labeling machine for the automatic transfer of a label having a pressure sensitive adhesive from a translucent release backing to a package containing a product or to the surface of a product (said package and product being hereinafter referred to as the "product"), said machine comprising:

(a) a machine frame;

(b) a supply reel operative to support thereon a roll of labels and release backing on which aid labels are laminated in spaced apart relation, said reel being rotatably assembled to said machine frame;

(c) a takeup reel operative to receive and store said backing after said labels have been removed therefrom, said takeup reel being rotatably assembled to said machine frame, said backing normally extending along a defined path between said supply and takeup reels;

(d) first driving means connected to sa to urge said takeup reel to rotate and to maintain tension on said backing;

(e) a label stripping device assembled to said frame intermediate said supply reel and said takeup reel along said defined path and adapted to strip said labels from said backing, said label stripping device comprising:

(i) a pair of substantially parallel equal-length stripping bars each having a first and a second end;

(ii) a pair of substantially parallel side plates mounted to said first and second end respectively of said stripping bars and rotatably adjustable to position said stripped label accurately in said first position on said platen; and (iii) releasable clamping means capable of allowing the rotational adjustment and the locking of said side plates and stripping bars in the adjusted position;

(f) second driving means operative to intermittently move said backing and labels, said second driving means assembled to said frame along said defined path intermediate said label stripping device and said takeup reel;

(g) a label applicator mounted to said frame adjacent said label stripping means adapted to hold each said label stripped by said stripping means and operative to apply said label to a product in a labeling location, said label applicator comprising:

(i) linearly actuatable motivating means adapted to move between a label receiving position and a label applying position; and (ii) a platen adapted to hold a label thereto by vacuum means and mounted to said motivating means;

(h) a product conveyor adapted to transport said product from a supply location to said labeling location, said conveyor positioned between said supply location and said labeling location;

(i) a product stopping gate mounted on said conveyor and adapted to intercept the travel of said product on said conveyor at said labeling location;

(j) a product approach sensing switch positioned and operative to sense said product as said product is approaching said labeling location and operative to actuate said product stopping gate;

(k) a product position sensing switch positioned and operative to sense said product when said product is in said labeling location and operative to actuate said label applicator;

(l) a label sensing switch positioned and operative to sense each said label advanced by said second driving means and to stop said second driving means in response to sensing said label;

(m) a first electrical timer connected and operative to control the time interval of downward travel of said linearly actuatable motivating means of said label applicator and in response to the termination of said time interval to then initiate upward travel thereof;

(n) means capable of creating a vacuum, said means being pneumatically attached to and operative to create said vacuum at said label holding platen; and (o) a second electrical timer connected and operative to delay the application of said vacuum.

* * * * *

UNITED STATES PATENT AND TRADEMARK OFFICE

CERTIFICATE OF CORRECTION

PATENT NO. : 5,232,540

DATED : August 3, 1993

INVENTOR(S) : Paul R. Southwell, Walter C. Miller, Jr., Harold A. McKew, Jr.

It is certified that error appears in the above-indentified patent and that said Letters Patent is hereby corrected as shown below:

Column 10, line 52, correct "coated" to read --located--.
Column 12, line 25, insert --(c)-- before "a label".
Column 13, line 14, correct "to sa" to read --so as--.

Signed and Sealed this

Twenty-ninth Day of March, 1994

*Attest:*

Bruce Lehman

BRUCE LEHMAN

*Attesting Officer*

*Commissioner of Patents and Trademarks*